US005923928A

United States Patent [19]

Sugimoto

[11] Patent Number: 5,923,928

[45] Date of Patent: Jul. 13, 1999

[54] DUSTLESS TONER IMAGE TRANSFER APPARATUS AND METHOD

[75] Inventor: Hiroyuki Sugimoto, Kawasaki, Japan

[73] Assignee: Ricoh Company, Ltd., Tokyo, Japan

[21] Appl. No.: 09/023,002

[22] Filed: Feb. 12, 1998

[30] Foreign Application Priority Data

Feb. 13, 1997 [JP] Japan ..... 9-028845

[51] Int. Cl.[6] ..... G03G 15/18

[52] U.S. Cl. ..... 399/154; 399/297; 399/298; 399/302

[58] Field of Search ..... 399/130, 154, 399/177, 178, 297, 298, 300, 302, 308, 310, 313, 223, 231

[56] References Cited

U.S. PATENT DOCUMENTS 3,797,930 3/1974 Tanaka et al. ..... 399/154 X
3,846,019 11/1974 Yamaguchi et al. ..... 399/154
4,408,864 10/1983 Hardenbrook ..... 399/154
4,956,676 9/1990 Fukae et al. ..... 399/302
4,994,855 2/1991 Ohashi et al. ..... 399/154
5,247,334 9/1993 Miyakawa et al. ..... 399/154

*Primary Examiner*—Sandra Brase
*Attorney, Agent, or Firm*—Cooper & Dunham LLP

[57] ABSTRACT

An image forming apparatus including an image carrier, an image data storing device for storing image data, a latent image forming device for forming a first latent image on the image carrier in a state of negative image of said image data and for forming a second latent image on a copy sheet or the like in a state of a positive and mirror image of the image data. The image forming apparatus further includes a developing device for negatively developing the first latent image with toner, a feeding device for synchronously feeding the sheet with rotation of the image carrier toward a toner transfer station of the image carrier and a toner image transfer device for transferring the toner image onto the second latent image carried on the sheet or the like at the toner transfer station to superimpose the toner image on the second latent image.

60 Claims, 4 Drawing Sheets

FIG. 2
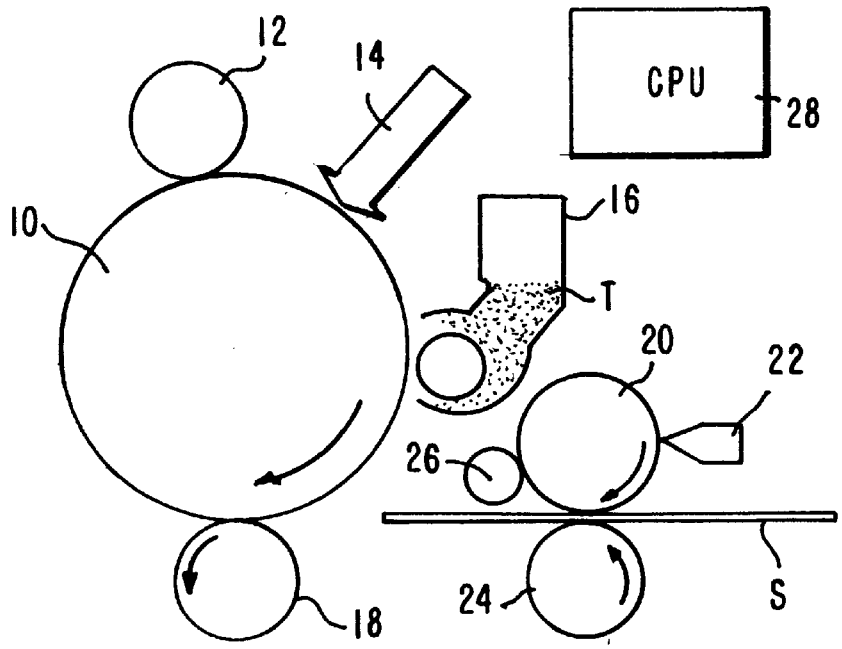
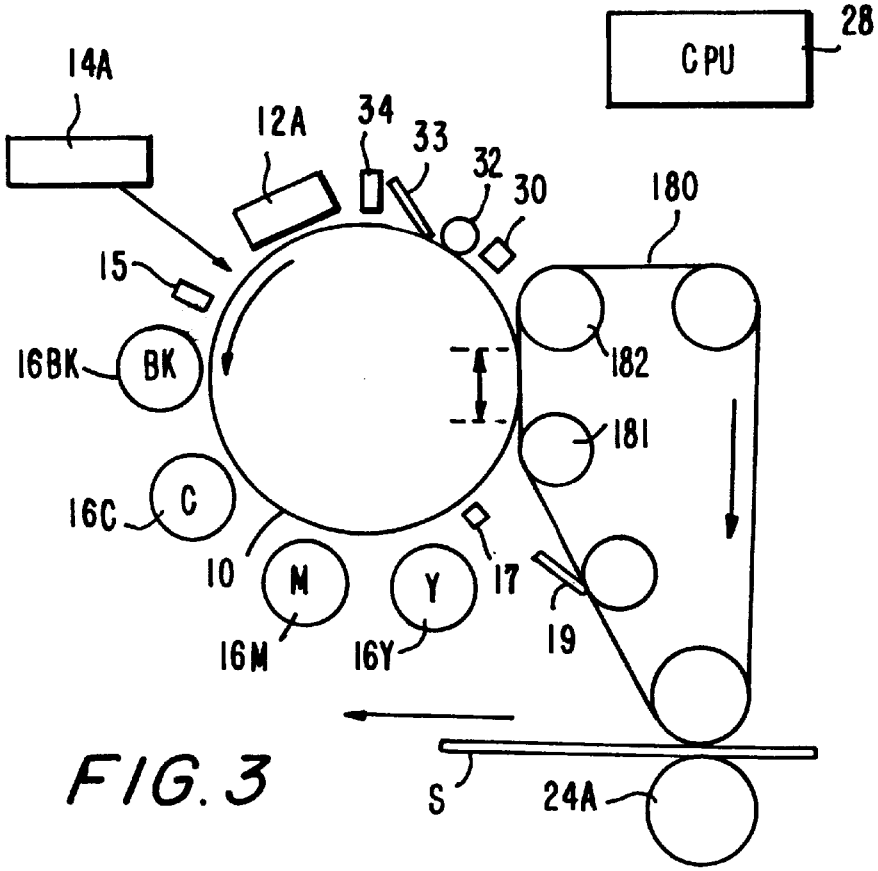
FIG. 3

10
180
180B
180A
$V_S$ 10
180
180B
180A

IMAGE CARRIER
-600
-300
-100
INTERMEDIATE TRANSFER MEMBER
550
750
900
200V
150V
350V
NEGATIVE LATENT IMAGE TRANSFER

POTENTIAL OF INTERMEDIATE TRANSFER MEMBER Vp(V)
-500
-400
-300
-200
-100
0
0
-500
-1000
-1500
-2000
DIFFERENCE IN POTENTIAL Vst(V)

DUSTLESS TONER IMAGE TRANSFER APPARATUS AND METHOD

BACKGROUND OF THE INVENTION

1. Field of the Invention

The present invention relates to image forming apparatus (which may be analog or digital, e.g. copiers, facsimile machines, printers including an electrostatic printing system, optical printers, etc.) and methods capable of transferring a toner image from an image carrier onto a sheet or like printing medium. More particularly, the present invention relates to toner image transfer devices and methods capable of suppressing transfer toner dust, which tends to be generated when the toner image is transferred from the image carrier onto the printing medium.

2. Discussion of the Background

In conventional analog or digital image forming apparatus, for example, copiers, printers, facsimile machines, etc., a latent image is formed on an image carrier and is developed with dry type toner to obtain a toner image. Such a toner image is usually transferred onto a printing medium such as a sheet of paper or the like under transfer bias voltage. The toner image may be transferred from the image carrier either directly onto the printing medium, or onto an intermediate transfer member for subsequent transfer therefrom to the printing medium.

However, in such conventional analog or digital image forming apparatus, when a toner image formed on an image carrier is transferred onto a printing medium or an intermediate transfer member, some amount of transfer toner dust generally and unavoidably appears on the printing medium or the intermediate transfer member used in a color printer or the like, and accordingly, sharpness of the toner image transferred is generally lost.

One reason why such transfer toner dust appears is that toner particles adjoining each other at an edge portion of the toner image tend to disperse due to the repelling force (coulomb force) existing therebetween, since each of those toner particles is electrically charged with charge of the same polarity before the developing process is executed. Thereby the toner particles spread onto the printing medium or the intermediate transfer member when such toner is transferred onto the printing medium. Accordingly, sharpness of the toner image is lost since the outline of the toner image is disturbed when the toner particles disperse as described above.

Further, it is known that such transfer toner dust more frequently appears when a toner image is transferred onto an intermediate transfer member than when the toner image is transferred onto the printing medium (printing sheet).

SUMMARY OF THE INVENTION

The present invention broadly contemplates the provision of apparatus and methods for forming a toner image wherein a transfer latent image is formed on a sheet or like printing medium, or on an intermediate transfer member, before the toner image is transferred thereto from an image carrier.

More particularly, the invention in a first aspect contemplates the provision of image forming apparatus including an image carrier having a surface for bearing an electrostatic latent image; an image forming device for forming a first electrostatic latent image on the carrier surface; a developing device for delivering toner to the first electrostatic latent image on the carrier surface to form thereon a toner image of the first electrostatic latent image; and a toner image transfer device for transferring the toner image from the carrier surface to a receiving surface; wherein the image forming device is or includes a device for also forming a second electrostatic latent image on the receiving surface before the toner image is transferred thereto, the second electrostatic latent image being a mirror image of the first electrostatic latent image; and the transfer device is or includes a device for juxtaposing the receiving surface and the carrier surface, for transfer of the toner image from the carrier surface to the receiving surface, such that the second electrostatic latent image is in register with the toner image on the carrier surface. The receiving surface, in this apparatus, can be a surface of a sheet (e.g. of paper) or other printing medium; in such case, the juxtaposing device may be or include a device for delivering the printing medium into toner-image-receiving juxtaposition with the carrier surface. Alternatively, the transfer device may include an intermediate transfer member and the receiving surface may be a surface of the intermediate transfer member.

The invention in a second aspect embraces a method of forming and transferring an image including the steps of forming a first electrostatic latent image on an image carrier surface, developing the first electrostatic latent image on the carrier surface with toner to form a toner image on the carrier surface, and transferring the toner image from the carrier surface to an image receiving surface, in combination with the further steps of forming a second electrostatic latent image on the receiving surface before transferring the toner image thereto, the second electrostatic latent image being a mirror image of the first electrostatic latent image, and juxtaposing the receiving surface and the carrier surface, for transfer of the toner image form the carrier surface to the receiving surface, such that the second electrostatic latent image is in register with the toner image on the carrier surface. Again, the receiving surface may be a surface of a printing medium and the juxtaposing step may deliver the printing medium into toner-image-receiving juxtaposition to the carrier surface; or the second surface may be a surface of an intermediate transfer member, and the method may further include the step of transferring the toner image from the immediate transfer member surface to a surface of a printing medium.

In one embodiment, the image forming apparatus comprises an image carrier, a data storing device for storing image data, a first latent forming device for forming a first latent image on the image carrier this first image being a negative image of image information; and a second latent image forming device for forming a second latent image on a copy sheet or the like, the second image being a positive and mirror image of the aforesaid image information. The image forming apparatus further comprises a developing member for negatively developing the first latent image with toner; a feeding member for feeding the sheet synchronously with rotation of the image carrier toward a toner transfer station of the image carrier; and a toner image transfer device for transferring the toner image onto the second latent image carried on the sheet or the like at the toner transfer station to superimpose said toner image on the second latent image.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 2 is a schematic cross sectional view of a first example of an image forming apparatus, capable of directly transferring a toner image from an image carrier onto a printing medium, in accordance with the present invention;

FIG. 3 is a schematic sectional view of a second example of an image forming apparatus having an intermediate transfer belt on which a toner image formed on an image carrier is initially transferred and is subsequently transferred onto a sheet, also in accordance with the present invention;

DESCRIPTION OF THE PREFERRED EMBODIMENTS

Figure 1A:
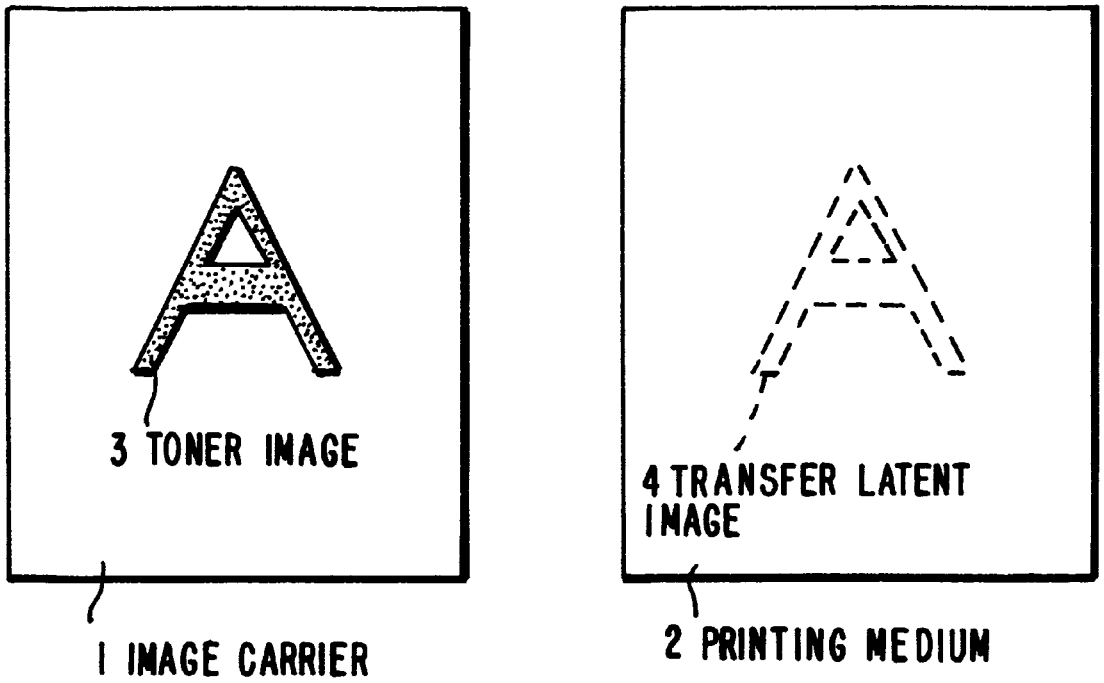
FIG. 1*a* is a diagram showing the status of the surfaces of an image carrier and a printing medium or an intermediate transfer belt before a toner image is transferred from the image carrier onto the printing medium or the intermediate transfer belt, showing the positional relation between a toner image formed on the image carrier (left) and a positive transfer latent image formed on the printing medium or the intermediate transfer belt (right)

Referring now to the drawings, wherein like reference numerals designate identical or corresponding parts throughout the several views, embodiments of the present invention are explained hereinbelow.

The first embodiment of the present invention is explained referring to FIG. 2. As shown in FIG. 2, a digital copier as an example of an image forming apparatus of the present invention is described.

The digital copier basically includes an image carrier 10 which has a drum shape and is grounded and rotated clockwise for carrying both a latent image and a toner image thereon.

The digital copier further includes a charge applying device including a roller 12 which rotates in contact with the surface of the image carrier 10 for evenly charging the surface with electric charge having negative polarity, for example; an optical writing device 14 for writing image information on the image carrier 10 by irradiating the carrier surface with a light beam under control of an optical signal to form a negative latent image by selectively eliminating charge carried on the image carrier 10 corresponding to a toner image to be formed; and a developing device (negative to positive) 16 which stores dry type toner T having a charge of negative polarity, for example, for inversely (negative to positive) developing the negative latent image formed on the surface of the image carrier 10 under a bias voltage having negative polarity, for example, applied by a bias applying member, not shown. The location at which toner from the developing device develops the latent image on the carrier 10 is hereinafter sometimes referred to as the developing station.

The digital copier further includes a toner image transfer roller 18 which rotates counterclockwise in contact with the image carrier 10 (so as to define therewith a nip through which a sheet passes) for transferring the toner image obtained at a developing station onto a sheet S fed from a sheet cassette, not shown, under a toner image transfer bias applied by a toner image bias applying member, not shown, to the toner image transfer roller 18.

The digital copier further includes a cleaning device, not shown, which is disposed in pressure contact with the image carrier 10 for cleaning the surface thereof after a toner transfer process is finished. The digital copier also includes a fixing device, not shown, for fixing the toner image to the sheet S and an ejecting device, not shown, for ejecting the sheet S from the digital copier after the fixing process is completed.

The digital copier additionally includes a charge eliminating member, not shown, disposed adjacent the surface of the image carrier 10 to eliminate charge remaining on the surface of the image carrier 10 after a toner cleaning process is completed, thereby preparing for the next image forming process which begins with charging of the image carrier 10 by the charge applying roller 12.

The digital copier further includes a transfer latent image carrying roller 20 which is capable of carrying a transfer latent image thereon and is grounded. The transfer latent image carrying roller 20 comprises an electrically conductive drum (grounded) and a dielectric thin film made of, for example, silicon rubber or plastic material, coated on the surface of the electrically conductive drum.

In addition, the digital copier includes a pin array charger 22 which is disposed adjacent the transfer latent image carrying roller 20 for forming a transfer latent image on the surface of the transfer latent image carrying roller 20 by selectively applying charges having a dot shape and predetermined polarity thereby forming the transfer latent image based upon an image signal generated by a CPU 28 as explained below in detail. The pin array charger 22 comprises a plurality of extremely thin needle shaped electrodes so arranged that each of the electrodes is electrically isolated from all the other electrodes and each side face of each electrode is aligned in an array state.

The digital copier further includes a latent image transfer roller 24, which is made of a metal core roller and an insulating layer coated around the surface of the metal core roller and contacts the transfer latent image carrying roller 20 (i.e., defining therewith a nip through which the sheet S passes) to form a latent image transfer station. The latent image transfer roller 24 rotates counterclockwise, and transfers the transfer latent image carried on the transfer latent image carrying roller 20 onto the sheet S under a toner transfer bias voltage (having opposite polarity to that of the transfer latent image) which is applied by a toner transfer biasing device, not shown.

The transfer latent image carrying roller 20 and the latent image transfer roller 24 cooperatively feed the sheet S toward the nip of the toner transfer station formed between the toner transfer roller 18 and the image carrier 10. The digital copier further includes a transfer charge eliminating member 26, which is made of electrically conductive material and rotates counterclockwise in contact with the latent image carrying roller 20 for eliminating charge remaining on the surface thereof after the transfer latent image is transferred onto the sheet S.

The digital copier further includes a central processing unit (CPU) 28 comprising a micro computer for controlling at least the optical writing device, the transfer latent image forming device including the pin charger array unit 22, the transfer latent image carrying roller 20 and the latent image transfer roller 24, and a feeding roller, not shown, for feeding the sheet T toward the transfer latent image carrying roller 20.

Hereinbelow, operation of the above described first embodiment of the present invention is explained in detail. Firstly, a surface of the image carrier 10 is uniformly charged with charge having negative polarity. After that, a document to be copied is read by a document reading devices, not shown, and image information obtained by the document reading device receives image processing in an image processing part of the CPU 28 to generate an optical digital signal and is stored in memory therein.

The optical digital signal is applied to the optical writing device 14 to optically write image information on the image carrier 10 and form a negative latent image of the information of the document. Namely, a portion of the surface of the image carrier 10 is irradiated by the optical writing device 14. The latent image is after that developed by a dry type developing device 16 with a dry type toner having a negative polarity in an inverted developing method under a developing bias voltage having the same polarity as that of the latent image, namely, negative polarity, to obtain a positive toner image on the surface of the image carrier 10.

After that, the toner image advances to the transfer station (nip between carrier 10 and roller 18) in accordance with rotation of the image carrier 10. Before the toner image arrives at the toner transfer station, a below described transfer latent image forming process is executed. Namely, the sheet S which is to serve as a printing medium is fed in the direction indicated by arrow A in FIG. 2. The optical digital signal having image information obtained by the document reading device as described earlier is applied to the pin array charger 22 from the CPU 28 to form a transfer latent image on the surface of the latent image carrying roller 20 with a plurality of electrostatic charges having an opposite polarity to that of the toner image, namely, positive polarity.

The sheet S is controlled by the CPU 28 to synchronously enter into the nip (between roller 20 and 24) which constitutes the latent image transfer station so as to precisely receive the transfer latent image on a predetermined portion thereof. The latent image transfer process is executed by using a TESI method (Transfer of Electrostatic Image method) including applying a bias voltage to the latent image transfer roller 24. Namely, a bias having opposite polarity to that of the transfer latent image formed on the transfer latent image carrying roller 20 is applied to the latent image transfer roller to electrically attract the transfer latent image onto the sheet S. Thereby a mirror image of a toner image to be formed on the image carrier 10 is formed on the sheet S.

Since an insulating layer is coated around the metal core roller of the latent image transfer roller 24, when the transfer latent image is transferred onto the sheet S at the nip, between rollers 20 and 24, the back side of the sheet S is not charged with electrical charge, resulting in a stable transportation of the sheet until it is ejected to the outside from the digital copier. Further, some of charge remaining on the transfer latent image carrying roller 20 is eliminated by the charge eliminating member 26 comprising a roller having electrical conductivity, for example, after the transfer latent image is electrically transferred onto the sheet S.

Figure 1B:
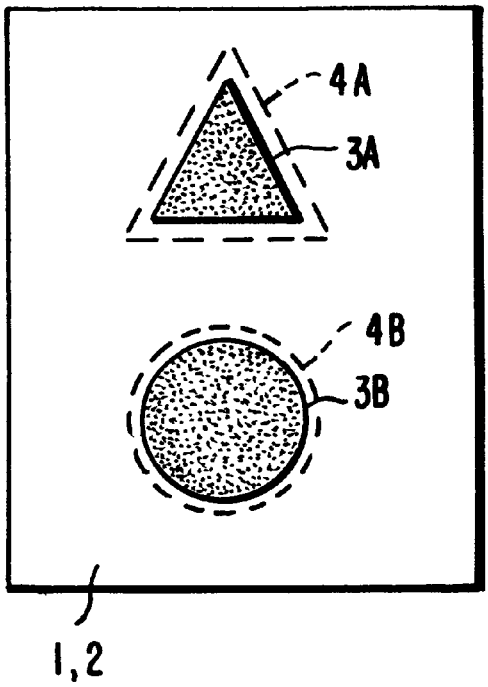
FIG. 1*b* is a diagram showing the status of the surface of a printing medium or an intermediate transfer belt after a toner image is transferred onto the surface thereof, illustrating the positional relation between a toner image having a triangle shape and a circle shape transferred thereon, and a negative transfer latent image formed on the surface of either the printing medium or the intermediate transfer belt outside (surrounding) the triangle shape and the circle shape as represented by dotted lines.

Since the sheet S carries a mirror latent image of the toner image to be formed on the image carrier 10 as shown in FIGS. 1*a* and 1*b*, when it is synchronously fed to the nip of the toner transfer station formed between the transfer roller 18 and the image carrier 10, the toner image shown in FIG. 1*a* is precisely transferred onto the sheet S shown in FIG. 1*b* so as to precisely superimpose the toner image on the transfer latent image carried on the sheet S.

This is because the transfer latent image formed on the transfer latent image carrier 20 precisely corresponds to the latent image formed on the image carrier 10 which is to be developed. Since the polarity of the transfer latent image is opposite to that of the toner image carried on the image carrier 10, the toner image transferred onto the sheet S firmly attracts to the electrical charge of the transfer latent image with coulomb force. Thereby, the toner existing on the edge portion of the toner image cannot disperse, and accordingly, transfer toner dust never appears on the sheet S. As a result, desired sharpness of the toner image transferred onto the sheet S is obtained.

In the above described embodiment, the polarity of the transfer latent image to be carried on the sheet S can be the same as that of the toner image to be formed on the image carrier 10, if the absolute value of electrical charge potential on a portion to receive a toner image thereon of the sheet S is smaller than other portions. In other words, a negative latent image of the toner image which has electrical charge of the same polarity as that of the toner image can be used as a transfer latent image. This is because the toner image having electrical charge tends to attract to a portion having lower absolute value of electrical potential if the polarity of charge of the toner image and that of the surface of the image carrier is the same. In such an image transfer process, a bias voltage having positive polarity can be applied to easily attract the toner image onto the transfer latent image carried on the sheet S.

Further, for synchronously feeding the sheet S to the toner transfer station with rotation of the image carrier 10 for precisely superimposing a toner image carried on the image carrier on the transfer latent image carried on the sheet S, there can be used conventional sheet feeding technology heretofore employed in a multiple color image forming apparatus where a printing medium having a mono-color toner image thereon is synchronously fed to a transfer station again to precisely receive a different mono color toner image thereon.

Further, a non-contact type charge applying device, for example, a corotron charger or a scorotron charger for charging the image carrier 10 with electrical charge, spaced from the image carrier 10, can be employed instead of the above described roller type charge applying device 12.

Further, an analog type exposure system using light reflected from a document can be used to form a positive latent image on the image carrier 10 in place of the above described optical writing device 12, and further, a conventional corona charger can be used for the above described roller type latent image transfer roller 24.

Hereinbelow, modifications of the above described first embodiment are explained. Firstly, the transfer latent image carrying roller 20 shown in FIG. 2 can be movably disposed between two positions, such that the transfer latent image carrying roller 20 first contacts a surface of an image carrier 10 at a location between a developing station and a toner transfer station thereof to receive a transfer latent image previously formed on the image carrier 10 at a first position thereof, and then separates therefrom to contact (form a nip with) an latent image transfer roller 24 at the second of the two positions thereof.

In such a first modification, an image forming process is executed as explained below. Before the transfer latent image carrying roller 20 contacts the surface of the image carrier 10, a negative latent image (the state of which is a mirror image of the image subsequently formed on the image carrying roller for development with toner) formed on the image carrier as a transfer latent image. After that, the latent image is transferred onto the transfer latent image carrying roller 20 while the roller 20 contacts the surface of the image carrier 10, thereby forming on roller 20 a latent image the state of which is a mirror image of the latent image formed on the image carrier 10.

The transfer latent image carrying roller 20 separates from the surface of the image carrier 10 and moves toward the latent image transfer roller 24 to contact again (from a nip with) the roller 24 after the latent image transfer process is completed. The transfer latent image is after that transferred onto a sheet S synchronously fed from a sheet cassette, not shown. A transfer latent image is thereby precisely received on the sheet, thereby the transfer latent image formed on the surface of the image carrier 10 is finally carried on the sheet S in the same state as the latent image formed on the surface of the image carrier 10, since the mirror image carried on the image carrier 10 is transferred two times.

A negative latent image to be developed is newly formed on the surface of the image carrier 10 and is developed at the developing station by using an inverted developing method as described in the first embodiment, whereby a positive latent image is obtained. The sheet S is after that synchronously fed under control of the CPU 28 toward the toner transfer station nip formed between the image carrier 10 and the toner transfer roller 18 to precisely receive the positive toner image on the negative transfer latent image carried on the sheet S.

The toner image is precisely superimposed on the negative transfer latent image, since the transfer latent image is the mirror image of the negative image of the toner image. Thereby, the same result as obtained in the first embodiment is obtained in this first modification.

In addition, the pin charger array unit 22 employed in the first embodiment can be omitted in this modification.

In a second modification of the copier of FIG. 2, the sheet feeding path (shown in FIG. 2) is in the form of a loop which passes through at least the nip of the toner transfer station for feeding a sheet S through the nip twice. In such a modification, an image forming process is executed as described below. A transfer latent image is firstly formed on the surface of the image carrier 10. The sheet S is after that synchronously fed along the loop shaped feeding path under control of the CPU 28 toward the toner transfer station and receives the transfer latent image from the surface of the image carrier 10 by using a TESI method as described earlier, in a first feeding cycle.

After the transfer latent image is transferred onto the sheet S, charge remaining on the surface of the image carrier 10 is eliminated by a charge eliminating member, not shown, and a new latent image to be developed, having the same state as the transfer latent image previously formed, is formed thereon again. However, if the latent image previously formed thereon still keeps a high enough voltage to be used again, the same can be used as both the transfer latent image and the latent image developed with toner, so that a new latent image is not formed. The new latent image (or the original latent image, if used both as the transfer latent image and the latent image to be developed with toner) is developed by a dry type developing member 16 to obtain a positive toner image by using an inverted (negative to positive) developing method as employed in the first embodiment since a negative latent image is formed on the surface of the image carrier 10.

The toner image is transferred onto the sheet S synchronously fed toward the toner transfer station along the loop shaped feeding path in the second feeding cycle. The toner image is precisely superimposed on the negative transfer latent image carried on the sheet S. Thereby, the same result as obtained in the first embodiment is obtained in the second modification. In addition, a mirror latent image to be formed on the image carrier 10 for a transfer latent image as needed in the first modification, and the transfer latent image carrying roller 20 used therein can be omitted in this modification.

Thirdly, the image forming apparatus as described in one of the first embodiment and the aforementioned modifications is used as a component of a full color toner image forming apparatus and a plurality of the same components are disposed on a line at equal intervals in a predetermined order along a feeding path for feeding a sheet S. Further, different mono color dry type toners, for example, yellow toner, magenta toner, cyan toner and black toner, are respectively stored in the developing members disposed in each of the components. In such a device, a full color toner image is obtained in a manner as described below.

A transfer latent image is formed on a transfer latent image carrying roller 20 of the first component in a state of negative image of a toner image to be formed and is transferred onto a sheet S synchronously fed from a sheet cassette as described in the first embodiment. A latent image to be developed is formed on an image carrier of the component in the same state as previously formed on the surface of the image carrying roller 20, is developed by a first dry type mono color toner, for example, yellow toner, stored in the developing device 16 of the first component by using an inverted developing method, and is transferred onto the sheet S synchronously fed toward a toner transfer station of the image carrier.

The sheet S precisely receives the yellow toner image, for example, on the transfer latent image carried thereon, since the transfer latent image is a mirror image of the toner image on the image carrier and the sheet S having (carrying this transfer latent mirror image of the toner image) is synchronously fed to the toner transfer station of the image carrier under control of the CPU 28. Remaining mono color toner image forming processes are successively executed in the same manner as described above and the sheet S is fed in synchronism with each of the image carriers separately carrying different mono color toner images.

Each of the mono color images, a namely, yellow color image, a magenta color image, a cyan color image and a black color image, is transferred onto the same portion of the sheet S, since the sheet S is synchronously fed toward each of the toner transfer stations under control of the CPU 28 while carrying each of transfer latent images thereon having opposite polarity to that of the mono-color toner image formed on the image carrier 10. Thereby, a full color copy not having transfer toner dust is obtained.

In the above described first embodiment and the various modifications, a conventional corona electrical charge applying member for applying corona charge, for example, a scorotron charger and a corotron charger can be employed for the transfer roller 18. Further, in the above described transfer latent image forming process, in particular, start timing of each of the image forming processes is controlled by the CPU 28.

Hereinbelow, the second embodiment of the present invention is now explained in detail referring to FIG. 3. As shown in FIG. 3, a full color image forming apparatus which forms a full color toner image by separately forming a plurality of resolution mono color toner images, yellow, magenta, cyan and black toner images, for example, and superimposing each of those, is employed.

The full color toner image forming apparatus includes an image carrier 10 which rotates counterclockwise as illustrated in FIG. 3 and is composed of a hollow cylinder made of aluminum and a photo-conductive layer disposed around the hollow cylinder. The photo-conductive layer includes a base layer, an electrical charge generating layer and an electrical charge transfer layer for respectively generating and carrying a latent image, and has a thickness of 30 mm and a specific inductive capacity of 3.0, for example.

The full color image forming apparatus further includes a scorotron charger 12A for evenly charging a surface of the image carrier 10 with charge having a negative potential of, for example, −600v, and an optical writing device 14A for optically writing image information on the surface of the image carrier 10 to form a negative latent image having a negative electrical charge potential ranging from about −100v to about −500v, for example, thereon.

The full color image forming apparatus further includes a plurality of developing members 16Y, 16M, 16C and 16BK respectively disposed in a predetermined order and adjacent the image carrier 10 downstream of the optical writing device 14A for respectively storing yellow, magenta, cyan and black colored dry type toner and respectively developing the negative latent image formed on the surface of the image carrier 10 to form positive mono color toner images thereon using an inverted developing method under developing bias having a voltage of −500v, for example, applied by a bias applying device, not shown. An alternating current is superimposed on the developing bias voltage when necessary to enhance the quality of developing.

The full color image forming apparatus further includes a density sensor disposed adjacent to the image carrier 10 downstream of the plurality of the developing units 16Y, 16M, 16C and 16Bk for optically sensing the density of a toner image carried on the image carrier 10 and generating a density signal. The full color image forming apparatus further includes an intermediate transfer belt 180 for receiving both a negative transfer latent image and a positive toner image respectively formed on the surface of the image carrier 10.

The intermediate transfer belt 180 comprises a surface layer made of dielectric material, a PET film, for example, and a backside layer made of a metal thin film as an electrode and has thickness of 70 mm, for example. The surface layer of the intermediate transfer belt 180 has the same specific conductive capacity of 3.0 as that of the photoconductive surface of the image carrier 10, for example. The intermediate transfer belt 180 is trained around a plurality of winding rollers including a pair of bias applying rollers 181 and 182 and rotated by one of the rollers clockwise in a state such that the backside layer thereof always contacts each of the rollers including the pair of bias applying rollers 181 and 182 so as to enable bias voltage to be applied to the belt 180 by the pair of the bias applying rollers 181 and 182.

A portion of the intermediate transfer belt 180 located between the pair of the bias applying rollers 181 and 182 is disposed in pressure contact with to a portion of the surface of the image carrier 10 to form a nip having a predetermined length as a first latent image transfer station and a first toner transfer station so as to efficiently transfer both the latent image and the toner image onto the medium transfer belt 180 as shown in FIG. 3.

The full color image forming apparatus further includes a pre-cleaning charger 30 disposed adjacent the image carrier 10 and downstream of the first transfer station for charging the surface of the image carrier 10 with predetermined charge to regulate the charge amount of the toner remaining on the image carrier 10 after a process of transferring the toner image onto the intermediate transfer belt 180 is completed. The full color image forming apparatus further includes a mechanism, not shown, for bringing the intermediate transfer belt 180 into contact with, and separating the belt from, the surface of the image carrier 10.

The full color image forming apparatus further includes a cleaning device comprising a brush 32 and a blade 33 respectively disposed in pressure contact with the surface of the image carrier 10 downstream of the pre-cleaning charger 30 for cooperatively removing the toner remaining on the carrier surface, and a charge eliminating device 34 for eliminating the charge remaining on the surface of the image carrier 10 by applying charge having opposite polarity to that of the charge remaining on the surface.

The full color image forming apparatus further includes a toner image transfer roller 24A disposed in contact with a portion of the surface of the intermediate transfer belt 180 against one of the plurality of winding rollers thereof to form a nip therebetween as a second toner transfer station for transferring a full color toner image, for example, carried on the intermediate transfer belt 180 onto a sheet S including an OHP sheet synchronously fed from a sheet cassette, not shown, by using a conventional TESI method under toner image transfer bias applied by a toner transfer bias applying member, not shown.

The full color image forming apparatus further includes a belt cleaning blade 19 disposed downstream of the second toner transfer station in pressure contact with the intermediate transfer belt 180 against one of the plurality of the winding rollers of the intermediate transfer belt 180 for wiping off the toner remaining thereon after the toner transfer process is completed.

The full color image forming apparatus further includes a fixing device, not shown, disposed downstream of the second toner image transfer station on the sheet feeding path for fixing a full color toner image to the sheet S, and an ejecting roller, not shown, disposed downstream of the fixing member for ejecting the sheet S from the full color image forming apparatus. The full color image forming apparatus further includes a CPU 28 comprising a micro computer for controlling almost all of the members or devices of the full color image forming apparatus in the manner described below in detail.

Hereinbelow, operation of the above described full color image forming apparatus is now explained in detail, referring to the drawings. To form a full color toner image, one of the mono color toner image forming processes, for example, yellow, is firstly executed in a manner as described below.

Firstly, a surface of the image carrier 10 is uniformly charged by the charge applying device 12A having charge voltage of −600v, for example, during rotation of the image carrier 10 counterclockwise. A negative latent image as a transfer latent image is next formed thereon by the optical writing device 14A based upon an image signal sent from the CPU 28 in a state that the negative latent image has electrical charge potential ranging from about −100v to about −500v, and the background thereof has electrical charge potential of about 0v, for example.

Secondly, the negative latent image is transferred onto the intermediate transfer belt 180 rotating clockwise by using a TESI method under transfer bias of +900v, for example, applied onto the backside layer thereof by a pair of bias applying rollers 181 and 182 at the latent image transfer station of the image carrier 10 which is also used later as the first toner transfer station as described below in detail.

Thirdly, a new latent image to be developed is formed in the same state as the latent image previously formed on the surface of the image carrier 10 thereon and is developed at the developing station by using an inverted developing method, under bias voltage of −500v, for example. Namely, since both the charge on the toner and the charge on the latent image are the same and the bias voltage is applied, the negative latent image having −100v, for example, is developed with yellow toner even if having charge of negative polarity. Therefore, a positive yellow toner image is obtained on the surface of the image carrier 10 on the terms of using such bias voltage.

In the above, if the latent image firstly formed on the image carrier having been partially transferred from the image carrier still has enough electrical charge to be used for the latent image to be developed, the former latent image is used as a latent image to be developed rather than newly forming a second latent image thereon.

Fourthly, the yellow toner image is transferred onto the surface of the belt 180 having the negative transfer latent image synchronously rotating with the image carrier 10 to precisely receive the yellow toner image on the negative transfer latent image as shown in FIG. 1*b* under toner transfer bias having a voltage of +700v, for example, applied to the backside layer of the intermediate transfer belt 180 by the pair of transfer rollers 181 and 182. The yellow toner image carried on the image carrier 10 is therefore precisely inserted in the area having no or more charge on the intermediate transfer belt 180, namely superimposed on the negative latent image, and thereby the yellow toner image is firmly restricted by the background of the negative transfer latent image on the intermediate transfer belt 180; since the polarity of electrical charge of each of the toner image and the background of the negative latent image carried on the medium transfer belt 180 is the same, and the voltage of the background is larger than that of the negative latent image as described above, toner existing on an edge of the toner image can not disperse on the intermediate transfer belt 180.

The remaining mono color image forming processes (for magenta, cyan and black mono color) are then successively executed in the same manner as described above. Since the intermediate transfer belt 180 is rotated in synchronism with rotation of the image carrier 10 under control of the CPU 28, each of the mono color toner images carried on the image carrier 10 is always transferred onto the same portion of the surface of the intermediate transfer belt 180 carrying each of the negative latent images respectively formed on the same portion thereof. Thereby each of the mono color toner images is precisely superimposed on another mono color toner image previously carried on the intermediate transfer belt 180, if the sheet S is synchronously fed. Accordingly, a fine full color toner image not having transfer toner dust is created thereon.

Further, the full color toner image formed on the intermediate transfer belt 180 is finally transferred onto the sheet S at the nip of the second toner transfer station under a toner transfer bias having voltage of +2,000v, for example, and is after that fixed onto the sheet S by the fixing device, not shown. Thereby, a full color copy having no transfer toner dust, and accordingly having a sharp toner image, is obtained.

Hereinbelow, a transfer latent image transferring process to be executed between an image carrier 10 and an intermediate transfer belt 180 is explained in more detail for better understanding of the second embodiment according to experiment referring to FIGS. 4*a*, 4*b*, 4*c* and 4*d*.

Figures 4A, 4B, 4C, 4D:
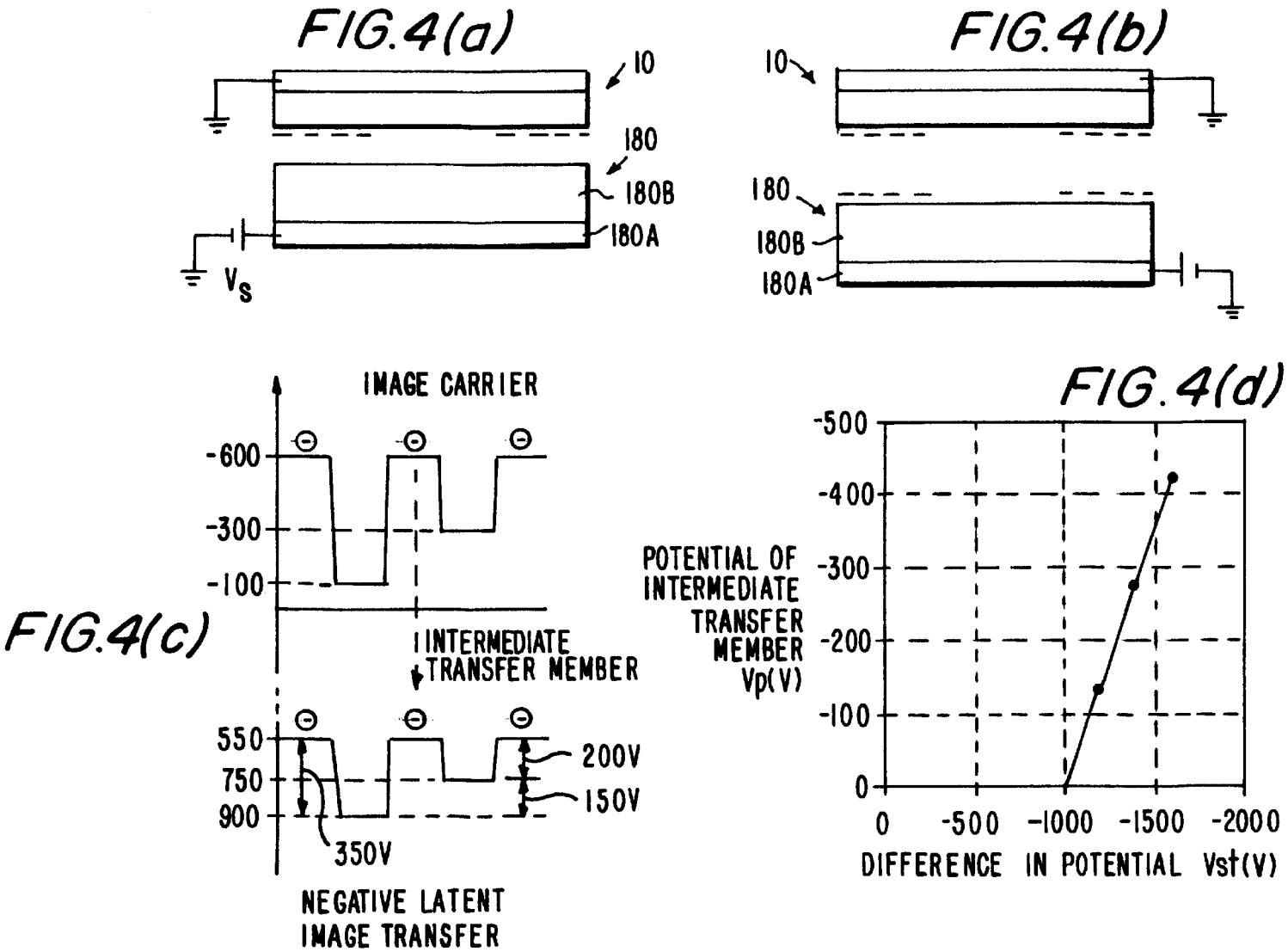
FIG. 4*a* is a diagram showing the electrical charge status of the surfaces of the image carrier and the intermediate transfer belt shown in FIG. 3 before a negative latent image formed on the image carrier is transferred onto the intermediate transfer belt.
FIG. 4*b* is a similar diagram showing the electrical charge status of the surfaces of the image carrier and the intermediate transfer belt shown in FIG. 3 after a negative latent image formed on the image carrier is transferred onto the intermediate transfer belt.
FIG. 4*c* is an electrical potential graph illustrating (top) the electrical potential distribution of electrical charge of a transfer latent image formed on an image carrier as shown in FIG. 4*a* before transfer of a negative latent image from the image carrier onto the intermediate transfer belt starts, and (bottom) the corresponding electrical potential distribution of electrical charge newly formed on the intermediate transfer belt after the transfer is completed under transfer bias having a voltage of +900V.
FIG. 4*d* is a graph showing the relation between the difference in electric potential Vst between a surface of an intermediate transfer belt to which a bias voltage of +900v is applied and a surface of an image carrier having a potential distribution of electrical charge which is made by the transfer latent image, and the corresponding potential distribution Vp (V) of electrical charge of a transfer latent image to be formed on the intermediate transfer belt after the transfer latent image is transferred onto the intermediate transfer belt under the bias voltage of +900v.

As shown in FIG. 4*a*, a negative latent image comprising electrical charge having negative polarity, for example, is formed oil a surface of an image carrier 10. Bias voltage Vs is applied onto a backside layer 180A of the intermediate transfer belt 180 as an electrode. When the surface of the dielectric layer 180B contacts the surface of the image carrier 10 at a transfer station as shown in FIG. 3 under transfer bias having voltage of +900v, for example, some of the latent image is transferred onto the surface of the dielectric layer 180B.

Accordingly, after the intermediate transfer belt 180 is separated from the image carrier 10, namely, a portion of the intermediate transfer belt 180 contacting the surface of the image carrier 10 passes through the nip of the transfer station formed between the image carrier 10 and the intermediate transfer belt 180 as shown in FIG. 3, a latent image is newly formed on the surface of the intermediate transfer belt 180 in the state of a mirror image of the negative latent image formed on the surface of the image carrier 10 as shown in FIG. 4*b*, which will be used when a toner image formed later on the surface of the image carrier 10 is transferred on to the surface of the intermediate transfer belt 180.

Hereinbelow, how a transfer latent image is newly formed on the intermediate transfer belt is explained in detail using an electrical potential graph, referring to FIGS. 4*c* and 4*d*. The distribution of electrical charge potential of a latent image and a background thereof respectively on the surface of the image carrier 10 before the latent image is transferred from the image carrier 10 to an intermediate transfer belt 180 is in a state as shown in the tope curve of the graph of FIG. 4*c*.

Since, as described above, the surface of the image carrier 10 is uniformly charged with charge having a voltage of −600v by a charge applying device 12A, and after that, the optical writing device 14A optically writes image information based upon an image signal obtained from a document, for example, a negative latent image has electrical charge potential of −100v and −300v and a background thereof has electrical charge potential of −600v as shown in the top graph of FIG. 4(*c*). After such a transfer latent image is transferred onto a surface of the intermediate transfer belt 180 under bias voltage of +900v, an negative latent image transferred thereto has electrical charge potential of −0v and −150v itself respectively corresponding to each of the electrical charge potential of −100v and −300v, and the background thereof has voltage of −350v corresponding to the electrical charge potential of −600v as understood from the bottom curve of FIG. 4(*c*).

Each of the voltages of 0v, −150v and −350v will be realized, if the bias voltage of +900v is removed from the backside layer 180A of the intermediate transfer belt 180. Namely, each of which is respectively obtained by respectively subtracting each electrical potential including charge potential of the latent image of +900v, +750v and +550v shown in the lower graph from that of the bias voltage of +900v.

It has been ascertained from experience that such electrical charge potential to be newly formed on the surface of the intermediate transfer belt 10 is in proportion to the difference in electrical potential between the surfaces of the image carrier 10 having a negative latent image formed thereon and the intermediate transfer belt 180, namely, a bias voltage applied to the backside layer thereof. Electrical charge potential transferred onto the intermediate transfer belt 180 can therefore be obtained, if the difference is known beforehand and referring to the relation therebetween as shown in FIG. 4*d*.

In FIG. 4*d*, the vertical axis shows electrical charge potential to be newly formed on a surface of an intermediate transfer belt 180 after a transfer latent image has been transferred thereto, whereas the horizontal axis shows the difference in electrical potential between a surface of an image carrier having an transfer latent image thereon and the surface of the intermediate transfer belt 180 before the transfer latent image is transferred thereto, namely each of those corresponds to electrical charge potential of the transfer latent image formed on the surface of the image carrier 10 and bias voltage applied to backside layer of the intermediate transfer belt 180.

Therefore, if electrical charge potential of the transfer latent image formed on the image carrier 10 has electrical potential of −300v as shown in the top curve of FIG. 4(*c*) and the bias voltage applied onto the backside of the intermediate transfer belt 180 has that of +900v as shown in the bottom curve thereof, the difference in electrical potential between them is +1200v in total. Further, electrical charge potential of the negative latent image to be formed on the surface of the intermediate transfer belt 180 corresponding to the difference of +1200v is obtained by identifying an intersecting point of both perpendicular line passing through +1200v and a graph as shown in FIG. 4(*d*).

Figure 5A:
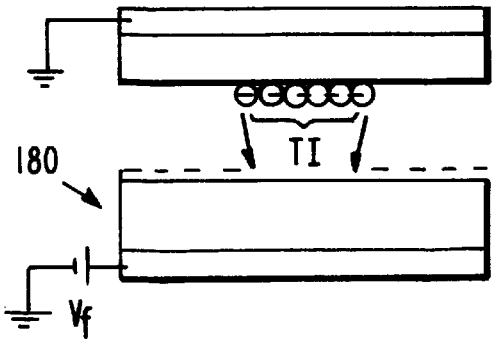
FIG. 5*a* is a diagram showing the status of a surface of an image carrier carrying a portion of a toner image TI thereon which is obtained by an inverted (negative to positive) developing method and a surface of an intermediate transfer belt carrying a negative transfer latent image facing the toner image including the toner portion TI before a toner transfer process is executed.
Figure 5B:
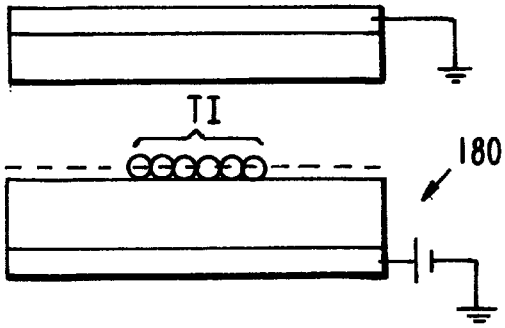
FIG. 5*b* is a similar diagram showing the status of the surfaces of the image carrier and the intermediate transfer belt having the toner image portion TI transferred from the image carrier after a toner transfer process is executed under toner image transfer bias Vf.

Hereinbelow, why a toner image attracts firmly to the transfer latent image carried on the medium transfer belt 180 is explained using a toner model and wells formed by an electrical potential graph referring to FIGS. 5*a*, 5*b* and 5*c*. Firstly, as shown in FIG. 5*a*, a portion of toner image TI having a negative polarity is carried on a surface of the image carrier 10 after a developing process is executed thereon. When such a toner image TI is transferred onto the surface of the intermediate transfer belt 180, the toner image TI is adjusted to precisely position and contact a portion not having charge of the negative transfer latent image carried on the intermediate transfer belt 180 as shown in FIG. 5*a* by synchronously rotating the intermediate transfer belt 180 with the image carrier 10. The part of the toner TI is therefore transferred onto the surface of the intermediate transfer belt 180 as shown in FIG. 5*b*.

Figure 5C:
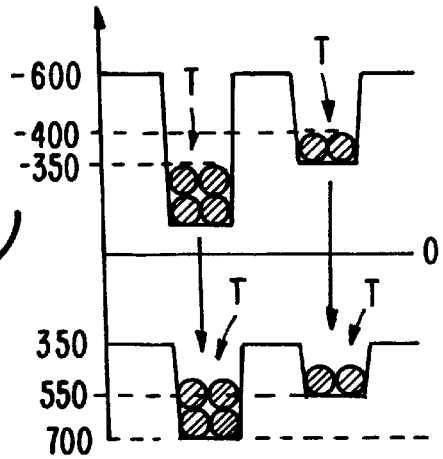
FIG. 5*c* is an electrical potential graph illustrating (top) the electrical potential distribution including charge voltage of a toner image itself carried on an image carrier and a toner model for explaining a restricting force of each of electrical potential wells formed by this top curve of the graph, and (bottom) the electrical potential distribution including charge voltage of a transfer latent image correspondingly formed on an intermediate transfer belt and a bias voltage of +700v and a toner model for explaining a restricting force of each of electrical potential wells formed by this bottom curve of the graph.

Before such toner image transfer process is executed, the distribution of electrical potential of the toner image and a background thereof appears as shown in the top curve of FIG. 5(*c*). This is because a negative latent image to be developed is newly formed in the same state as the transfer latent image previously formed, accordingly distribution of electrical charge potential having −100v and −300v on the surface of the image carrier 10 as shown in the to curve of FIG. 4*c* is obtained. After such a negative latent image is negatively developed by using an inverted developing method under bias voltage having −500v, a positive toner image is obtained on the surface of the image carrier 10 and has electrical potential distribution of −400v (including the toner's own charge voltage of −100v) and −350v (including the toner's own charge voltage of −250v) respectively, comprising a toner image as shown in the top curve in FIG. 5*c*.

On the other hand, a background portion of the surface of the image carrier 10 which does not have a toner image therein has electrical potential of −600v as shown in the top curve of both FIG. 5*c*. Further, since toner transfer bias having electrical voltage of +700v is applied onto the backside layer 180A of the intermediate transfer belt 180 while a toner image transfer process is executed, and the portions of the transfer latent image respectively have electrical charge voltages of 0v and −150v before the toner transfer bias voltage of +700v is applied, the electrical potential distribution of the surface of the intermediate transfer belt 180 carrying a transfer latent image thereon comprises voltages of +700v and +550v in total.

Further, a background not having the negative transfer latent image has an electrical potential of +350v as shown in the bottom curve of FIG. 5*c*, when such developing bias is applied, since the portion had electrical charge voltage of −350v before the toner transfer bias voltage of +700v is applied as understood from the bottom curve of FIG. 4*c*.

Since the bias voltage as described above is applied, toner having its own electrical charge potential of −250v installed in a left well formed by the top curve of FIG. 5(*c*) is transferred onto a portion having the electrical potential of +700v of the transfer latent image formed on the intermediate transfer belt 180, namely, a left well of the bottom curve of FIG. 5(*c*), and toner having its own electrical charge potential of −100v installed in a right well formed by the top curve thereof is transferred onto a portion having an electrical potential of +550v of the transfer latent image formed on the intermediate transfer belt 180, namely, the right side of the bottom curve thereof.

Thereby the electrical potential distribution of the surface of the intermediate transfer belt under the bias voltage of +700v comprises portions having a voltage of +450v in total including the charge of the transfer latent image and the toner's own charge as illustrated by the toner particle models respectively installed in the right and left wells. Each of electrical potentials +700v and +550v respectively shown in the bottom curve of FIG. 5(*c*) is obtained, when the latent image having electrical charge distribution of 0v and −150v as described earlier is transferred onto the surface of the intermediate transfer belt 180 under the bias voltage of +700v applied to the backside layer thereof.

Further, since the electrical potential on a background portion not having transfer latent image on the surface of the intermediate transfer belt 180 is +350v and each of the portion having toner thereon has that of +450v in total as shown in the bottom curve, each of the toner portions is restricted with its own electrical potential of +100v (+450v−350v) within each of corresponding wells as shown in the bottom curve of FIG. 5*c*.

Since, each of the toner portions are firmly kept within each of the wells and, further, the polarity of the background of the transfer latent image carried on the surface of the intermediate transfer member 180 and the toner image transferred thereon is the same, the toner image can not disperse to other portions on the surface thereof and accordingly transfer toner dust never occurs during the toner image transfer process. As a result, a sharp toner image is reproduced.

Further, since a background on the image carrier 10 has electrical charge potential of −600v itself as shown in the top curve of FIG. 5*c*, and the electrical potential of the background of the intermediate transfer belt 180 has a voltage of +350v as shown in the bottom curve, the difference in electrical potential becomes +950v in total which exceeds the bias voltage of +700v, electrical charge on the background of the image carrier 10 never transfers onto the background of the intermediate transfer member 180; thereby only a toner image on the image carrier 10 can be transferred thereto since the difference in electrical potential between both surfaces does not exceed the bias voltage of +700v.

By such operation, one of the mono color toner image forming processes (e.g., for yellow) is completed. To obtain the full color toner image, mono color toner image forming processes for magenta, cyan and/or black are successively executed in the same manner as described above. And, after all of the mono color toner images have been formed and superimposed on the same portion of the surface of the intermediate transfer belt 180 under control of the CPU 28, a full color toner image is formed thereon and is finally transferred onto a sheet S including OHP sheet at a second toner transfer station formed between the intermediate transfer belt 180 and the toner transfer roller 24A under toner transfer bias having voltage of +2,000v, for example.

Further, in such an image forming apparatus, since the electrical potential of the intermediate transfer belt 180 increases according as a plurality of mono color toner image are superimposed thereon, wells as shown in FIG. 5*c* can be formed deeper than that formed in a previous mono color toner transfer process to firmly catch the toner TI therein by gradually increasing the bias voltage step by step.

Hereinbelow, a relationship obtained from experience between the number of transfer toner dust particles appearing on the intermediate transfer belt 180 and the difference in electrical potential between a toner image portion and a background thereof not having a toner image on the surface of the intermediate transfer belt 180 after the toner image transfer process is executed is explained, referring to FIG. 6.

Figure 6:
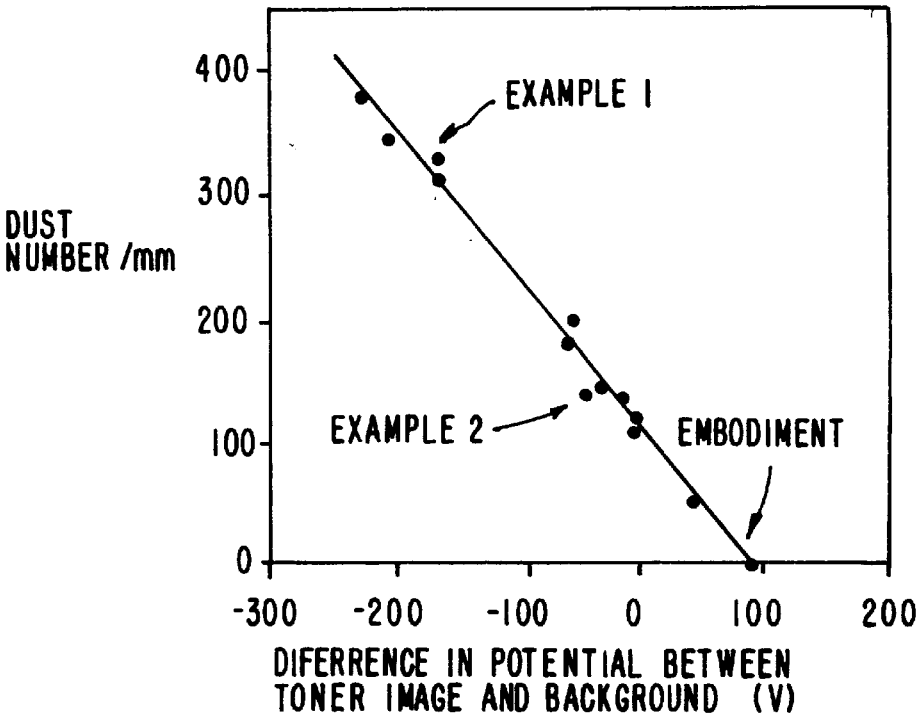
FIG. 6 is a graph showing the relation between the difference (V) in electric potential between a toner image portion and a background portion thereof not having the toner image therein on an intermediate transfer belt after a toner image transfer process has been executed to transfer the toner image onto the intermediate transfer belt, and the number of transfer toner dust particles appearing on the surface of the intermediate transfer belt per mm. of a line state toner image.

In FIG. 6, the number of toner particles dispersed is indicated on the vertical axis thereof. Such a number is obtained by counting toner dots dispersed from an edge portion of a line image of the toner image per unit length thereof using a magnifying glass, and is plotted on the vertical axis thereof. Further, the difference in an electrical potential between a toner image portion and a background thereof is shown on the horizontal axis. Such difference is obtained by varying electrical resistance of the intermediate transfer belt 180 and/or conditions for forming a transfer latent image. It is apparent when referring to FIG. 6 that the larger the difference in positive electrical potential between the toner image portion and the background thereof on the surface of the intermediate transfer member 180, the smaller the number of the transfer toner dots.

This is because the toner having a charge of negative polarity attracts stronger to the transfer latent image having less potential formed on the surface of the intermediate transfer belt 180 if the polarity of both is the same. Further, the larger the difference in negative electrical potential between them, the larger the number of the transfer toner dots. In addition, the more the toner dots, the more the transfer toner dust and, accordingly the less sharpness of the toner image.

The example (1) plotted upper part of the graph showing the relation between the number of toner dots and the difference in potentials as shown in FIG. 6 is obtained when material having middle range electrical resistance is used for the intermediate transfer belt 180. The reason why such a large number of the toner dots dispersed is that a transfer latent image transferred onto such an intermediate transfer belt easily disappears due to less ability of holding the transfer latent image thereof.

Whereas in the second embodiment of the present invention having a difference in electrical potential of +100v between the toner image portion and the background thereof, such toner dots are not or rarely found as shown at bottom portion of the graph shown in FIG. 6. Further, if a transfer latent image used in the second embodiment is not used for a toner transfer process, a certain amount of toner dot is found as shown at about the middle portion of the graph shown in FIG. 6.

Hereinbelow, modifications of the second embodiment are explained. Firstly, a single color copy, for example, a black color copy, can be made by using only a black toner developing device 16BK as shown in FIG. 3, if each of a negative latent image forming process, a latent image transfer process and a toner transfer process and so on as described above is controlled to execute only one time for making a black toner.

Secondly, an electrode member 22 composed of a pin array charger as shown in FIG. 2 can be used to form a transfer latent image directly on the intermediate transfer belt 180 for the image carrier 10 shown in FIG. 3.

Thirdly, it is possible to make a full color copy in a different way to that described above, if the image forming apparatus as described above is used as a component for forming only one mono color toner image therein and a plurality of the components respectively having different mono color toners from each other therein are disposed in a line to allow a sheet S to be fed through each of the transfer stations thereof, and each of the mono color toner images is superimposed thereon.

Fourthly, all of the four transfer latent images can be continuously formed on an image carrier 10 in different rotations thereof and transferred therefrom onto the intermediate transfer belt 180 respectively or at one time before a developing process of a first mono color toner image forming process starts to be executed on the image carrier 10. Namely, each of the mono color toner images is after that formed and respectively transferred onto one of the corresponding transfer latent images.

Fifthly, a dielectric image carrier can be used for the image carrier 10 and a pin array charger or a PIN tube or the like can be used (for forming a latent image either to be developed or to be transferred) as the optical writing device 14A used in the second embodiment of the present invention. Sixthly, a belt type image carrier having a seamless belt or a seam belt can be used for the drum type image carrier 10. Seventhly, a drum type or a belt type intermediate transfer member comprising a seam belt or a seamless belt can be used for the belt type medium transfer belt 180.

This application is based on Japanese Application No. 9-028845 filed Feb. 13, 1998 which is incorporated herein by reference.

Obviously, numerous additional modifications and variations are possible in light of the above teachings. It is therefore to be understood that within the scope of the appended claims, the present invention may be practiced otherwise than as specifically described herein.

What is claimed is:

1. An image forming apparatus comprising:

a data storing device for storing image information;

an image carrier for carrying latent image and a toner image thereon;

a toner image receiving member for receiving a toner image thereon;

a latent image forming device for forming a first latent image having predetermined polarity on said image carrier in a state of negative image of said image information; and for forming a second latent image having predetermined polarity on said toner image receiving member in a state of positive and mirror image of said image information;

a developing device for inversely developing said first latent image with toner having charge of predetermined polarity at a developing station of said image carrier, thereby to provide a toner image of said first latent image;

a feeding device for synchronously feeding said toner image receiving member with rotation of said image carrier toward a toner transfer station of said image carrier; and a toner image transfer device for transferring said toner image of said first latent image onto said second latent image at said toner transfer station to superimpose said toner image on said second latent image.

2. An image forming apparatus as claimed in claim 1, wherein said second latent image has opposite polarity to that of said toner image of said first latent image.

3. An image forming apparatus as claimed in claim 2, further comprising a toner transfer bias applying device for applying bias voltage having opposite polarity to that of said toner image of said first latent image to a back side of said toner image carrying device.

4. An image forming apparatus as claimed in claim 2, further comprising a toner image transfer bias applying device for applying bias voltage having opposite polarity to that of said toner image while said toner image is transferred onto said toner image receiving member.

5. An image forming apparatus as claimed in claim 1, wherein said latent image forming device forms said second latent image in a state of negative image of said image information with a charge of predetermined polarity, and includes:

a latent image carrying roller for receiving and carrying said second latent image thereon, and a latent image transfer device for transferring said second latent image from said latent image carrying roller onto said toner image receiving member.

6. An image forming apparatus as claimed in claim 5, further comprising a latent image transfer bias applying device for applying bias voltage having opposite polarity to that of said second latent image to said latent image transfer device.

7. An image forming apparatus as claimed in claim 5, wherein said latent image forming device includes a pin array charger for forming said second latent image on said latent image carrying roller.

8. An image forming apparatus as claimed in claim 7, wherein said pin array charger is controlled to form a second latent image onto said latent image carrying roller in a same state as said first latent image.

9. An image forming apparatus as claimed in claim 5, wherein said latent image forming device forms said second latent image on said image carrier.

10. An image forming apparatus as claimed in claim 9, wherein said latent image carrying roller is capable of contacting and separating from said image carrier for receiving a second latent image from said image carrier.

11. An image forming apparatus as claimed in claim 9, wherein said image carrier is controlled to form a second latent image onto said latent image carrying roller in a same state as said first latent image while said latent image carrier contacts to said image carrier.

12. An image forming apparatus as claimed in claim 1, further comprising a toner image transfer bias applying device for applying bias voltage having opposite polarity to that of said toner image while said toner image is transferred onto said toner image receiving member.

13. An image forming apparatus as claimed in claim 1, wherein said latent image forming device forms said second latent image on said image carrier, and further comprising a transporting path having a loop shape for transporting said toner image receiving member through both a latent image transfer station and said toner transfer station.

14. An image forming apparatus as claimed in claim 13, further comprising a transport controller for synchronously transporting said toner image receiving member toward each of said transfer stations to firstly receive said second latent image and secondly receive said toner image on said second latent image through said transporting path.

15. An image forming apparatus comprising:

a data storing device for storing image information;

an image carrier for carrying a latent image and a toner image thereon;

a toner image receiving member for receiving a toner image thereon;

a latent image forming device for forming a first latent image having predetermined polarity on said image carrier in a state of negative image of said image information; and for forming a second latent image having predetermined polarity on said toner image receiving member in a state of negative and mirror image of said image information;

a developing device for inversely developing said first latent image with toner having charge of predetermined polarity at a developing station of said image carrier, thereby to provide a toner image of said first latent image;

a feeding device for synchronously feeding said toner image receiving member with rotation of said image carrier toward a toner transfer station of said image carrier, and a toner image transfer device for transferring said toner image of said first latent image onto a background of said second latent image formed on said toner image receiving member at said toner transfer station to insert said toner image in said background of said second latent image.

16. An image forming apparatus as claimed in claim 15, wherein said second latent image has the same polarity as that of said toner image of said first latent image.

17. An image forming apparatus as claimed in claim 16, further comprising a toner transfer bias applying device for applying bias voltage having opposite polarity to that of said toner image of said first latent image to a back side of said toner image carrying device.

18. A color image forming apparatus for forming a color toner image on a toner image receiving member, comprising:

a mono color image data storing device for storing image information for a plurality of mono color images therein, said mono color image forming units respectively comprising;

a plurality of mono color image forming units respectively disposed on a line for respectively forming different one of mono color toner images therein;

a transporting device for synchronously transporting said toner image receiving member along said mono color image forming units to receive each of said mono color toner images on a same portion thereof;

each of said mono color images forming units comprising:

an image carrier for carrying a latent image and a toner image thereon, a latent image forming device for forming a first latent image having predetermined polarity on a toner image receiving member in a state of mirror image of image information for one of said mono color images, and for forming a second latent image having predetermined polarity on an image carrier in a state of negative image of image information for said one mono color image, a developing device for inversely developing said second latent image with mono color toner having charge of predetermined polarity at a developing station of said image carrier by using a inverted developing method, a feeding device for synchronously feeding said toner image receiving device with rotation of said image carrier toward a toner transfer station of said image carrier, and a toner transfer device for transferring said mono color toner image onto said first latent image to superimpose said mono color toner image on said first latent image.

19. An image forming apparatus comprising:

a data storing device for storing image information;

an image carrier for carrying a latent image and a toner image thereon;

a toner image receiving member for receiving a toner image from said image carrier;

a latent image forming device for firstly forming a first latent image on said image carrier to be transferred therefrom having predetermined polarity in a state of negative image of image information for said image, and secondly forming a second latent image to be developed thereon in a same state as said first latent image;

a developing device for inversely developing said second latent image with toner having charge of predetermined polarity at a developing station of said image carrier;

a feeding device for synchronously feeding said toner receiving member with rotation of said image carrier toward a toner transfer station of said image carrier, and a transfer device for firstly transferring said first latent image to said toner receiving member and secondly transferred said toner image onto the transferred first latent image on said toner receiving member.

20. An image forming apparatus comprising:

a data storing device for storing image information;

an image carrier for carrying a latent image and toner image thereon;

an intermediate transfer member for initially receiving a toner image thereon from said image carrier;

a latent image forming device for firstly forming a first latent image on said image carrier to be transferred therefrom having predetermined polarity in a state of negative image of image information for said image, and secondly forming a second latent image to be developed thereon in a same state as said first latent image;

a developing device for inversely developing said second latent image with toner having charge of predetermined polarity at a developing station of said image carrier;

a rotating device for synchronously rotating said intermediate transfer member with rotation of said image carrier toward a toner transfer station of said image carrier, and a transfer device for firstly transferring said first latent image to said intermediate transfer member and secondly transferring said toner image onto the transferred first latent image on said intermediate transfer member.

21. A multicolor image forming apparatus for forming a multicolor toner image by superimposing a plurality of mono color toner images, said multicolor image forming apparatus comprising:

an image data storing device for storing image information for a plurality of mono color toner images;

an image carrier for carrying a latent image and a toner image;

a latent image forming device for forming a first latent image on said image carrier to be transferred therefrom in a state of a negative image of image information for one of said images and a second latent image to be developed thereon in a same state as said first latent image in a different rotation of said image carrier, respectively executed in each of plurality of mono color toner image forming processes;

a latent image transfer device for transferring said first latent image in each of plurality of mono color toner image forming processes;

a plurality of mono color developing devices for respectively developing one of said second latent images with a corresponding mono color toner by using a inverted developing method;

an intermediate transfer member for receiving each of said first latent images firstly and said toner image secondly on said first latent image, executed in each of the plurality of mono color toner image forming processes;

a rotating device for synchronously rotating said intermediate transfer member with rotation of said image carrier for receiving said toner image on said first latent image so as to insert said mono color toner image on said first latent image, executed in each of mono color toner image forming process, and a control device for controlling said first and second latent image forming devices to form each of the latent images on a same portion of said image carrier during a plurality of said mono color image forming processes, and said latent image transfer device to transfer said first latent image and said toner image on a same portion of said medium transfer member during a plurality of said mono color image forming processes.

22. A color image forming apparatus as claimed in claim 21, wherein each of said first latent image and second latent image have the same polarity.

23. A color image forming apparatus as claimed in claim 21, further comprising a latent image transfer bias applying device for applying bias voltage having opposite polarity to that of said first latent image to said intermediate transfer member while said first latent image is transferred thereto.

24. A color image forming apparatus as claimed in claim 21, further comprising a multicolored toner image transfer bias applying device for applying transfer bias voltage having opposite polarity to that of said mono color toner to said multicolored toner image transfer device while said multicolored toner image is transferred.

25. A color image forming apparatus as claimed in claim 21, wherein each of said second latent images is developed by a corresponding one of said mono color developing devices under developing bias voltage having same polarity as that of said second latent image while said toner image is transferred thereto.

26. A color image forming apparatus as claimed in claim 21, further comprising a multicolored toner image transfer device for transferring a multicolored toner image carried on said intermediate transfer member onto said toner image receiving member.

27. A color image forming apparatus as claimed in claim 21, wherein said bias voltage is controlled to increase said voltage according as said plurality of toner image transfer processes are executed.

28. A color image forming apparatus for forming a color toner image by superimposing a plurality of different mono color toner images, said apparatus comprising:

a data storing device for storing image information for a plurality of mono color images therein;

a plurality of different mono color image forming units respectively disposed in a line for respectively forming different mono color toner images therein, each of said mono color image forming units, comprising:

an image carrier for carrying a latent image and a toner image thereon;

a latent image forming device for forming a first latent image on said image carrier to be transferred therefrom in a state of a mirror image of image information for one of said mono color images and a second latent image to be developed on said image carrier in a same state of said first latent image, a mono color developing device for storing mono color toner therein and inversely developing said second latent image with said mono color toner by using a inverted developing method, an intermediate transfer member for receiving said first latent image firstly and said toner image secondly from said image carrier on a same portion thereof in a different rotation thereof, and a rotating device for synchronously rotating said intermediate transfer member with rotation of said image carrier for receiving each of said latent image and said toner image so as to insert said mono color toner image in said first latent image on said intermediate transfer member; and a delivering device for synchronously delivering a toner image receiving member along with said plurality of mono color image forming units to receive a plurality of different mono color toner images therefrom on a same portion of said toner image receiving member.

29. A method for transferring a toner image onto a toner image receiving member at a toner transfer station of an image carrier, said method comprising:

storing image information;

forming a first latent image of said image information on said toner image receiving member;

forming a second latent image on said image carrier in a state of negative image of said image information;

obtaining a positive toner image by developing said second latent image, and transferring said positive toner image onto said first latent image formed on said toner image receiving member.

30. A method as claimed in claim 29, further comprising applying bias voltage having opposite polarity to that of said toner image formed on said image carrier while said toner image is transferred onto said toner image receiving member.

31. A method for transferring a toner image onto a toner image receiving member at a toner transfer station of an image carrier, said method comprising:

storing image information;

forming a first latent image on said toner image receiving member in a state of positive and mirror image of said image information;

forming a second latent image on said image carrier in a state of negative image of said image information;

obtaining a positive toner image by inversely developing said second latent image by using an inverted developing method; and transferring said positive toner image onto said first latent image formed on said toner image receiving member.

32. A method for transferring a toner image onto a toner image receiving member at a toner transfer station of an image carrier, said method comprising:

storing image information;

forming a first latent image of said image information having predetermined polarity on said toner image receiving member;

forming a second latent image on said image carrier in a state of negative image of said image information;

obtaining a positive toner image by developing said second latent image with toner having the same polarity as that of said second latent image; and transferring said positive toner image onto said first latent image formed on said toner image receiving member.

33. A method for transferring a toner image onto a toner image receiving member at a toner transfer station of an image carrier, said method comprising:

storing image information;

forming a first latent image having predetermined polarity on said toner image receiving member in a state of a negative and mirror image of said image information;

forming a second latent image on said image carrier in a state of negative image of said image information;

obtaining a positive toner image by inversely developing said second latent image with toner having the same polarity as that of said first latent image by using an inverted developing method; and transferring said positive toner image onto said first latent image formed on said toner image receiving member.

34. A method for transferring a toner image onto a toner image receiving member via an intermediate transfer member from an image carrier, said method comprising:

storing image information;

forming a first latent image on said intermediate transfer member in a state of a negative and mirror image of said image information;

forming a second latent image on said image carrier in a state of negative image of said image information;

obtaining a positive toner image by inversely developing said second latent image by using an inverted developing method;

transferring said positive toner image onto said first latent image formed on said intermediate transfer member; and further transferring said toner image onto said toner image receiving member from said intermediate transfer member.

35. A method as claimed in claim 34, wherein said second latent image is developed with toner having the same polarity as that of said second latent image by using a inverted developing method.

36. A method as claimed in claim 35, further comprising applying bias voltage having opposite polarity to that of said toner image while said toner image is transferred onto said toner image receiving member.

37. A method as claimed in claim 34, further comprising applying bias voltage having opposite polarity to that of said toner image while said toner image is transferred onto said toner image receiving member.

38. A method for transferring a toner image onto a toner image receiving member at a toner transfer station of an image carrier, said method comprising:

storing image information;

forming a first latent image on a transfer latent image carrying device in state of negative image of said image information;

forming a second latent image on said image carrier in a same state as said first latent image;

transferring said first latent image onto said toner image receiving member;

obtaining a positive toner image by inversely developing said second latent image by using an inverted developing method; and transferring said positive toner image onto said first latent image carried on said toner image receiving member.

39. A method as claimed in claim 38, further comprising applying bias voltage while said positive toner image is transferred onto said toner image receiving member.

40. A method for transferring a toner image onto a toner image receiving member via an intermediate transfer member from an image carrier, said method comprising:

storing image information;

forming a first latent image on said image carrier in state of negative image of said image information;

transferring said first latent image onto said intermediate transfer member;

forming a second latent image on said image carrier in a same state as said first latent image;

obtaining a positive toner image by inversely developing said second latent image by using an inverted developing method; and transferring said positive toner image onto said first latent image transferred on said intermediate transfer member.

41. A method as claimed in claim 40, further comprising applying bias voltage while said first latent image is transferred onto said intermediate transfer member.

42. A method for forming a multicolored toner image as claimed in claim 41, further comprising:

forming a fifth latent image of yet another one of said plurality of resolution mono color images on said image carrier in a state of negative image of image information thereof;

transferring said latent image on a same area of said intermediate transfer member in which said first and third latent images are transferred; and, forming a sixth latent image on said image carrier in a same state as said fifth latent image;

obtaining a yet another positive mono color toner image by inversely developing said sixth latent image with yet another corresponding mono color toner by using a inverted developing method, and transferring said yet another positive mono color toner image onto said sixth latent image carried on said intermediate transfer member to obtain a third mono color toner image on said first and second mono color toner images.

43. A method as claimed in claim 42, further comprising applying bias voltage having opposite polarity to that of either said first, third and fifth latent image to said intermediate transfer member while said first, third and fifth latent images are respectively transferred.

44. A method as claimed in claim 43, further comprising further transferring said multicolored toner image onto said toner image receiving member from said intermediate transfer member.

45. A method for forming a multicolored toner image as claimed in claim 44, further comprising fixing said multicolored toner image to said toner image receiving member.

46. A method for forming a multicolored toner image as claimed in claim 42, further comprising applying bias voltage having opposite polarity to that of said toner images to said intermediate transfer member while said first, and third toner images are respectively transferred to said intermediate transfer member.

47. A method as claimed in claim 46, further comprising applying bias voltage having opposite polarity to that of said toner image to said intermediate transfer member while said toner image is transferred.

48. A method as claimed in claim 42, further comprising controlling said bias voltage to increase according as said mono color toner image transfer processes are repeated.

49. A method for forming a multicolored toner image by superimposing a plurality of mono color toner images, said method comprising:

storing image information for a plurality of resolution mono color images;

forming a first latent image of a predetermined one of said plurality of resolution mono color images on an image carrier in a state of negative image of image information thereof;

transferring said first latent image onto an intermediate transfer member;

forming a second latent image on said image carrier in a same state as said first latent image;

obtaining a first positive mono color toner image by inversely developing said second latent image with corresponding mono color toner by using a inverted developing method;

transferring said first positive mono color toner image onto said first latent image carried on said intermediate transfer member to obtain a first mono color toner image thereon;

forming a third latent image on said image carrier in a state of negative image of image information for said another one of said plurality of resolution mono color images; and transferring said third latent image onto said intermediate transfer member on a same area in which said first latent image is transferred;

forming a fourth latent image on said image carrier in a same state as said third latent image;

obtaining a second positive mono color toner image by inversely developing said fourth latent image with another corresponding mono color toner by using a inverted developing method, and transferring said second positive mono color toner image onto said third latent image carried on said intermediate transfer member to obtain a second mono color toner image on said first mono color toner image.

50. A method as claimed in claim 49, further comprising applying bias voltage having opposite polarity to that of either said first and third latent image to said intermediate transfer member while said first and third latent images are respectively transferred.

51. A method for forming a multicolored toner image as claimed in claim 49, further comprising applying bias voltage having opposite polarity to that of said toner images to said intermediate transfer member while said first and second toner images are respectively transferred to said intermediate transfer member.

52. A method as claimed in claim 51, further comprising further transferring said multicolored toner image onto said toner image receiving member from said intermediate transfer member.

53. A method as claimed in claim 49, further comprising controlling said bias voltage to increase according as said mono color toner image transfer processes are repeated.

54. A method as claimed in claim 53, further comprising applying bias voltage having opposite polarity to that of said toner image to said intermediate transfer member while said toner image is transferred.

55. Image forming apparatus including:

an image carrier having a surface for bearing an electrostatic latent image;

image forming means for forming a first electrostatic latent image on said carrier surface;

developing means for delivering toner to said first electrostatic latent image on said carrier surface to form, on said carrier surface, a toner image of said first electrostatic latent image; and means for transferring said toner image from said carrier surface to a receiving surface; wherein the improvement comprises:

said image forming means including means for forming a second electrostatic latent image on said receiving surface before said toner image is transferred thereto, said second electrostatic latent image being a mirror image of said first electrostatic latent image; and said transferring means including means for juxtaposing said receiving surface and said carrier surface, for transfer of said toner image from said carrier surface to said receiving surface, such that said second electrostatic latent image is in register with said toner image on carrier surface.

56. Apparatus as defined in claim 55, wherein said receiving surface is a surface of a printing medium and said juxtaposing means comprises means for delivering said printing medium into toner-image-receiving juxtaposition with said carrier surface.

57. Apparatus as defined in claim 55, wherein said transferring means includes an intermediate transfer member and said receiving surface is a surface of said intermediate transfer member.

58. A method of forming and transferring an image including the steps of:

forming a first electrostatic latent image on a carrier surface, developing said first electrostatic latent image on said carrier surface with toner to form a toner image on said surface, and transferring said toner image from said carrier surface to an image receiving surface, wherein the improvement comprises:

forming a second electrostatic latent image on said receiving surface before transferring said toner image thereto, said second electrostatic latent image being a mirror image of said first electrostatic latent image, and juxtaposing said receiving surface and said carrier surface, for transfer of said toner image from said carrier surface to said receiving surface, such that said second electrostatic latent image is in register with said toner image on the carrier surface.

59. A method according to claim 58, wherein the receiving surface is a surface of a printing medium and said juxtaposing step delivers said printing medium into toner-image-receiving juxtaposing to said carrier surface.

60. A method according to claim 58, wherein the second surface is a surface of an intermediate transfer member and further including the step of transferring the toner image from the intermediate transfer member surface to a surface of a printing medium.

* * * * *